US005097693A

United States Patent [19]

Kennedy

[11] Patent Number: 5,097,693

[45] Date of Patent: Mar. 24, 1992

[54] CONTINUOUS EXTRUSION APPARATUS

[75] Inventor: Stephen T. Kennedy, Preston, United Kingdom

[73] Assignee: United Kingdom Atomic Energy Authority, London, England

[21] Appl. No.: 530,786

[22] Filed: May 30, 1990

[30] Foreign Application Priority Data

Jul. 29, 1989 [GB] United Kingdom ..... 8917417

[51] Int. Cl.[5] ..... B21C 23/00

[52] U.S. Cl. ..... 72/262; 425/79; 425/224

[58] Field of Search ..... 72/60, 262; 425/79, 425/224, 374, 376.1, 381.2

[56] References Cited

U.S. PATENT DOCUMENTS

| | | | |
|---|---|---|---|
| 3,872,703 | 3/1975 | Green | 425/224 |
| 4,044,587 | 8/1977 | Green et al. | 425/374 |
| 4,054,048 | 10/1977 | Hagerman | 72/262 |
| 4,111,023 | 9/1978 | Moreau | 425/224 |
| 4,163,377 | 8/1979 | Moreau | 425/224 |
| 4,217,852 | 8/1980 | Nagai et al. | 72/262 |
| 4,484,876 | 11/1984 | Childs et al. | 425/224 |

FOREIGN PATENT DOCUMENTS

| | | | |
|---|---|---|---|
| 59-209419 | 11/1984 | Japan | 72/262 |

*Primary Examiner*—Jay H. Woo
*Assistant Examiner*—James P. Mackey
*Attorney, Agent, or Firm*—William R. Hinds

[57] ABSTRACT

Continuous extrusion apparatus in the form of a rotatable wheel having a peripheral endless groove for material to be extruded. An abutment having a die orifice protrudes into the groove. The sides of the abutment and of the groove are of complementary stepped form to inhibit the egress of material from between the sides of the groove and of the abutment.

8 Claims, 1 Drawing Sheet

CONTINUOUS EXTRUSION APPARATUS

This invention relates to apparatus for the continuous forming of material by extrusion.

Examples of apparatus for the continuous forming of material by extrusion are described in British Patent Specification Nos 1370894 (U.S. Pat. No. 3,765,216), 1,434,201, 1,566,152, 1,590,776, 2,028,207A, 2,103,527A and 2,176,728. Such apparatus typically comprises a rotatable wheel constituting a movable member and defining an endless groove around the wheel for the material to be extruded, a shoe member overlying part of the length of the groove, a stationary abutment portion associated with the shoe member and projecting into the groove so as to substantially block a portion of the groove, and at least one die orifice associated with the abutment portion for extrusion of the material therethrough as the wheel rotates.

One of the problems associated with such extrusion apparatus is that of 'flash' in the form of relatively thin slivers of waste material which extrude between the abutment member and the walls of the groove. The 'flash' represents a loss of material per cycle of the wheel and, therefore, is reflected in the economics of the extrusion process.

According to the present invention there is provided apparatus for the continuous forming of material by extrusion, which apparatus comprises rotatable wheel means constituting a movable member and defining an endless groove around the wheel means for containing material to be extruded, a stationary shoe member adapted to overlie part of the length of the groove, an abutment portion associated with the shoe member in such a manner as to project into the groove so as to substantially block a portion of the groove, and at least one die orifice associated with the shoe member or the abutment portion, whereby material in the groove is moved by frictional drag between the material and the surface of the groove towards the abutment portion as the wheel means rotates so that the material is extruded through the die orifice, the groove and the abutment portion having sides defining complementary circumferential steps in opposing relationship such that one of the steps is at each side of a central portion of the groove, the steps in the groove and in the abutment portion being arranged so as to define a relatively narrow gap therebetween, so that in operation a layer of the material forms therein, the abutment portion being arranged to define a relatively narrow space each side of the central groove portion, and the narrow gap and the narrow spaces being substantially the same thickness, each step in the abutment portion defining at least one circumferential groove therein.

Also according to the invention, there is provided apparatus for the continuous forming of material by extrusion, which apparatus comprises rotatable wheel means constituting a movable member and defining an endless groove around the wheel means for containing material to be extruded, a stationary shoe member adapted to overlie part of the length of the groove, an abutment portion associated with the shoe member in such a manner as to project into the groove so as to substantially block a portion of the groove, and at least one die orifice associated with the shoe member or the abutment portion, whereby material in the groove is moved by frictional drag between the material and the surface of the groove towards the abutment portion as the wheel means rotates so that the material is extruded through the die orifice, the groove and the abutment portion having sides defining complementary circumferential steps in opposing relationship such that one of the steps is at each side of a central portion of the groove, the abutment portion defining at least one circumferential groove in each step thereof, and the opposing steps defining a relatively narrow gap therebetween, thereby to inhibit the egress of the material from between the sides of the groove and the abutment portion. Preferably each relatively narrow gap has a width such that in operation a layer of the material forms therein. Desirably, each said step of the groove defines at least one circumferential groove therein.

BRIEF DESCRIPTION OF THE DRAWINGS

The invention will now be further described by way of example only with reference to the accompanying drawings, in which.

DETAILED DESCRIPTION

Figure 1:
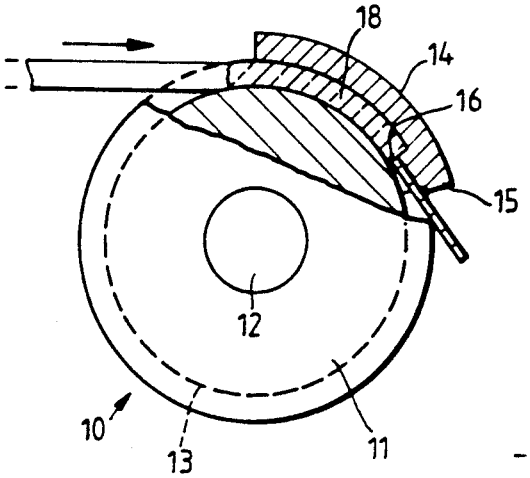
Fig. 1. PRIOR ART
FIG. 1 shows a side view in part section of a known apparatus for the continuous forming of materials by extrusion.

Referring now to FIG. 1, an extrusion apparatus 10 is shown of the kind described in the aforementioned Patent Specifications which are incorporated by reference herein. The apparatus 10 comprises a wheel 11 rotatably mounted on a shaft 12. The wheel 11 has an endless circumferential groove 13 around its outer edge, and a shoe member 14 overlies part of the length of the groove 13. An abutment portion 15 associated with the shoe member 14 is shaped so as to project into and substantially block the groove 13. The abutment portion 15 has an extrusion orifice 16 through which material 18 (e.g. aluminium) in the groove 13 is extruded as the wheel 11 rotates.

In operation, as the wheel 11 rotates the material 18 in the groove 13 is carried forward by the frictional drag of the walls of the groove 13 and forced against the abutment portion 15. Pressure is thus generated in the material 18 so that it is forced through the orifice 16.

Figure 2:
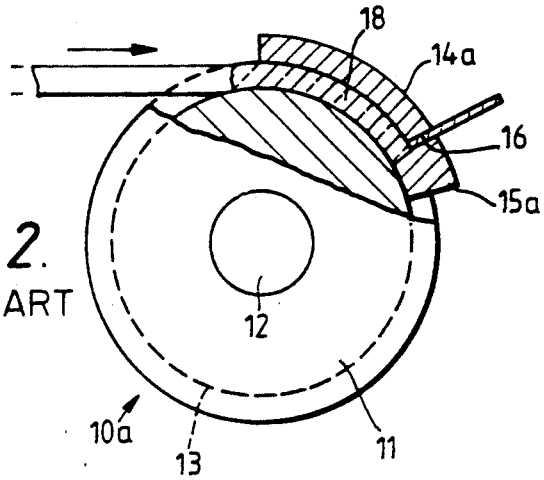
Fig. 2. PRIOR ART
FIG. 2 shows a known modification of the apparatus of FIG. 1.

The apparatus 10 of FIG. 1 has the orifice 16 located in the abutment portion 15 such that the material 18 is extruded tangentially with respect to the wheel 11. However, as shown in FIG. 2, an orifice 16 may be located in a shoe member **14*a* associated with an abutment portion 15*a* in an apparatus 10*a*, so that the material 18 extrudes radially through the orifice 16 with respect to the wheel 11. In other respects the apparatus 10*a* of FIG. 2 is the same as the apparatus 10 of FIG. 1**.

Because of the high extrusion pressures generated in the groove 13 of FIGS. 1 and 2, 'flash' of the material extrudes between the shoe member 14, **14*a* and the outside surface of the wheel 11**. Such 'flash' can be troublesome to deal with apart from the wastage of material it represents.

Figure 3:
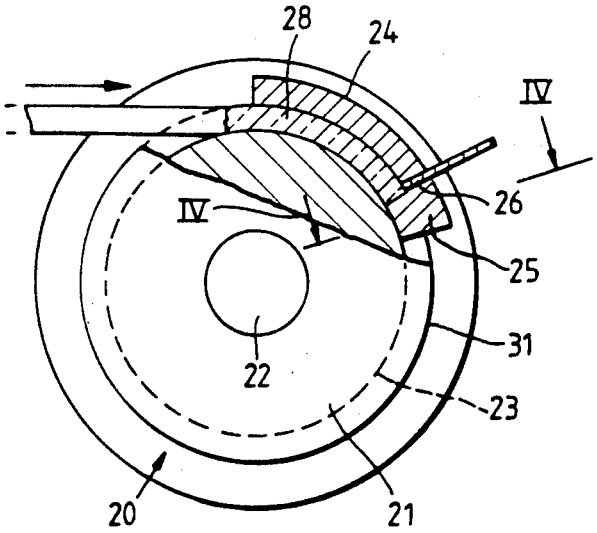
FIG. 3 shows a modification of apparatus of FIG. 2 in accordance with the invention.

Referring now to FIG. 3, a continuous extrusion apparatus 20 is shown similar in many respects to the apparatus of FIG. 2, and comprises a wheel 21 rotatably mounted on a shaft 22. The wheel 21 has an endless circumferential stepped groove 23 around its outer edge, and a shoe member 24 overlies part of the length of the groove 23. An abutment portion 25 is associated with the shoe member 24, and has an extrusion orifice 26 through which material 28 (e.g. copper) in the groove 23 is extruded.

Figure 4:
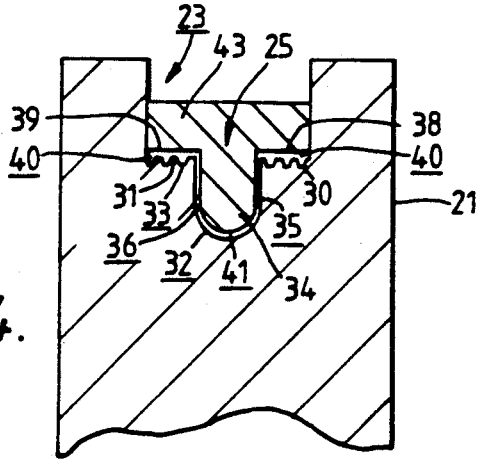
FIG. 4 shows a sectional view to an enlarged scale on the line IV—IV of FIG. 3.

The abutment portion 25 as shown more clearly in FIG. 4, is of stepped form to correspond with the stepped form of the groove 23. The groove 23 defines two circumferential shoulders 30, 31 respectively which locate one each side of a central groove 32, and have circumferential grooving 33. A tongue portion 34 of the abutment portion 25 extends into the central groove 32 and defines spaces 35, 36 respectively between the tongue portion 34 and the central groove 32. Two circumferential shoulders 38, 39 of the abutment portion 25 locate in opposing relationship to the shoulders 30, 31 to define relatively narrow gaps 40 (e.g. about 2.5 mm at ambient temperatures). A narrow gap 41 is also defined between the bottom of the central groove 32 and the tongue portion 34 in accordance with long-standing practice in the art, but there is only a very slight clearance between the sides of the upper section 43 of the abutment portion 25 and the sides of the groove 23.

In operation, material 28 (e.g. copper) as the wheel 21 rotates is carried forward by the frictional drag of the walls of the groove 23 and is forced against the abutment portion 25 so that it is forced through the die orifice 26. Some of the material 28 remains at the bottom of the central groove 32 in the gap 41 to form a layer therein. Some of the material 28 escapes through the spaces 35, 36 between the tongue portion 34 and the central groove 32 into the narrow gaps 40 to form layers therein which subsequently act as seals to prevent the ingress of further material 28, the grooving 33 acting to key the layers of material 28 in the narrow gaps 40. Hence the production of 'flash' or waste material is considerably reduced.

The thickness of the narrow gap 40 necessary may vary as the diameter of the wheel 21 is changed, and possibly as the material 28 is changed. It may be found advantageous in some applications for the spaces 35, 36 to be the same thickness as the narrow gaps 40.

Although the shoulders 30, 31 have been shown as extending parallel to the rotational axis of the wheel 21, the shoulders may have other orientations and shapes. Corresponding changes may need to be made to the alignment of the shoulders 38, 39. For some applications it might be possible to omit the grooving 33, and grooving of a similar nature might also be defined in the shoulders 38, 39 of the abutment portion 25. The use of steps at a single radius in the groove has been shown, but a plurality of steps at different radii might be used.

It will be appreciated that although the invention has been described in relation to the extrusion of copper, it should also be possible to use the invention to extrude aluminium or some other material, and the extruded material might be in tubular form. The invention may also be used in the apparatus of FIG. 1 and in other variants of the continuous extrusion apparatus.

Because of the relatively large surface area of material exposed to frictional forces, a greater clamping force on the shoe member 24 may be necessary than in the apparatus of FIGS. 1 and 2. Hence more power may be required to drive the wheel 21, and more heat generated for which the use of cooling means (not shown) for the wheel (21) may be adopted.

I claim:

1. Apparatus for the continuous forming of material by extrusion, which apparatus comprises rotatable wheel means constituting a movable member and defining an endless groove around the wheel means for containing material to be extruded, a stationary shoe member adapted to overlie part of the length of the groove, an abutment portion associated with the shoe member in such a manner as to project into the groove so as to substantially block a portion of the groove, and at least one die orifice associated with the shoe member or the abutment portion, whereby material in the groove is moved by frictional drag between the material and the surface of the groove towards the abutment portion as the wheel means rotates so that said material is extruded through the die orifice, wherein the improvement comprises, the groove and the abutment portion having sides defining complementary circumferential steps in opposing relationship such that one of said steps is at each side of a central portion of the groove, the steps in the groove and in the abutment portion being arranged so as to define a relatively narrow gap therebetween, so that in operation a layer of the material forms therein, the abutment portion being arranged to define a relatively narrow space each side of the central groove portion, and the narrow gap and the narrow spaces being substantially the same thickness, each step in the abutment portion defining at least one circumferential groove therein.

2. Apparatus as claimed in claim 1, wherein each step in the groove defines at least one circumferential groove therein.

3. Apparatus as claimed in claim 1, wherein the narrow gap is about 2.5 mm.

4. Apparatus for the continuous forming of material by extrusion, which apparatus comprises rotatable wheel means constituting a movable member and defining an endless groove around the wheel means for containing material to be extruded, a stationary shoe member adapted to overlie part of the length of the groove, an abutment portion associated with the shoe member in such a manner as to project into the groove so as to substantially block a portion of the groove, and at least one die orifice associated with the shoe member or the abutment portion, whereby material in the groove is moved by frictional drag between the material and the surface of the groove towards the abutment portion as the wheel means rotates so that said material is extruded through the die orifice, wherein the improvement comprises, the groove and the abutment portion having sides defining complementary circumferential steps in opposing relationship such that one of said steps is at each side of a central portion of the groove, the abutment portion defining at least one circumferential groove in each said step thereof, and the opposing steps defining a relatively narrow gap therebetween, thereby to inhibit the egress of the material from between the sides of the groove and the abutment portion.

5. Apparatus as claimed in claim 4, wherein each relatively narrow gap has a width such that in operation a layer of the material forms therein.

6. Apparatus as claimed in claim 4, wherein the abutment portion is arranged to define a relatively narrow space each side of the central groove portion, and the narrow gap and the narrow spaces are substantially the same thickness.

7. Apparatus as claimed in claim 6, wherein each step in the groove defines at least one circumferential groove therein.

8. Apparatus as claimed in claim 6, wherein the narrow gap is about 2.5 mm.

* * * * *